US006568017B2

(12) United States Patent
Cheo et al.

(10) Patent No.: US 6,568,017 B2
(45) Date of Patent: May 27, 2003

(54) WASHING MACHINE INCORPORATING DETERGENT TRAY

(75) Inventors: Francis C. Cheo, Newton, IA (US); Ted L. Hansen, Pella, IA (US); James B. Hull, Newton, IA (US); Evan R. Vande Haar, Pella, IA (US)

(73) Assignee: Maytag Corporation, Newton, IA (US)

( * ) Notice: Subject to any disclaimer, the term of this patent is extended or adjusted under 35 U.S.C. 154(b) by 93 days.

(21) Appl. No.: 09/945,617

(22) Filed: Sep. 5, 2001

(65) Prior Publication Data

US 2003/0041389 A1 Mar. 6, 2003

(51) Int. Cl.[7] ..... D06F 39/08
(52) U.S. Cl. ..... 8/158; 8/159; 68/208
(58) Field of Search ..... 8/158, 159; 68/208, 68/17 R, 18 D

(56) References Cited

U.S. PATENT DOCUMENTS 3,236,386 A 2/1966 Salisbury et al.
4,125,003 A 11/1978 Wasemann
4,485,645 A 12/1984 Mulder et al.
5,031,427 A 7/1991 Pastryk et al.

FOREIGN PATENT DOCUMENTS

DE 3609464 * 10/1987 ..... 68/208

* cited by examiner

*Primary Examiner*—Philip R. Coe
(74) *Attorney, Agent, or Firm*—Diederiks & Whitelaw, PLC

(57) ABSTRACT

A detergent collection tray is provided at a position spaced above a drain port in the sump area of an outer tub of a washing machine, particularly a horizontal axis washing machine. As detergent enters the washing machine during an initial fill operation, the detergent will be caused to flow into the tray and will be prevented from flowing directly into the drain. Therefore, the tray prevents the loss of detergent into the drain by functioning to capture or collect the detergent for use during the washing operation.

31 Claims, 4 Drawing Sheets

WASHING MACHINE INCORPORATING DETERGENT TRAY

BACKGROUND OF THE INVENTION

1. Field of the Invention

The present invention pertains to the art of clothes washing machines and, more particularly, to the incorporation of a detergent tray in a sump area of a washing machine.

2. Discussion of the Prior Art

A typical clothes washing operation includes the placing of clothes to be laundered within a wash or inner tub which is rotatable within an outer, fixed tub. Thereafter, water and detergent are added into the wash tub to form a cleaning solution. The clothes are then subjected to various wash, drain and rinse cycle portions. The inner tub is provided with a plurality of circumferentially spaced holes such that the cleaning solution is actually retained by the outer tub. The outer tub has associated therewith a port for draining the cleaning solution between consecutive cycle portions through the operation of a pump.

When filling the wash tub, a substantial portion of the detergent is actually directed right into the drain port in order to initially fill the drainage system. Typically, the first 10–15 seconds of fill time simply functions to fill the drain system. If detergent is introduced during this period, that detergent will actually be used to fill the drain system. Even if the introduction of the detergent is delayed, the detergent will tend to sink to this low point. In washing machines that incorporate a recirculation feature, the water and detergent in this drainage zone will still be available for use in the wash cycle. However, in such a washing machine arrangement, either an additional recirculation pump or complicated valving and flow structure must be employed to enable one pump to perform both recirculating and draining operations. That is, a pump would need to be used to reintroduce the detergent in the drainage zone back to the load of clothes being laundered. In washing machines which do not having recirculation features, the detergent concentration in the overall washing solution will be reduced due to a percentage of detergent being lost in the drainage zone.

In order to provide for a more effective overall washing operation, it would be desirable to provide an arrangement designed to capture a considerable percentage of the originally supplied detergent for use in the washing operation. Such an arrangement would be particularly advantageous in a washing machine which does not employ a recirculation system wherein, if the detergent enters the drainage zone, the detergent will be essentially isolated from the laundry and not available for washing the clothes.

Although it has been heretofore proposed in the art to provide a trap or strainer in a sump area of a washing machine, such as that disclosed in U.S. Pat. Nos. 3,236,386, 4,125,003 and 4,485,645, in order to collect foreign objects which may otherwise flow into and damage a drain pump, none of these arrangements is configured or functions to retain detergent therein in order to achieve the advantages of the present invention. Of course, a sump portion of a washing machine will inherently function to collect a percentage of the detergent supplied into the machine during initial operation. This fact is supported by the disclosure in U.S. Pat. No. 5,031,427 which is concerned with isolating the clothes being laundered from excessive suds. Regardless, a substantial portion of the detergent will still collect in the drain system during the washing portion of the machine cycle. However, since the '427 patent is concerned with a recirculating type washing operation, the problem of lost detergent is, to some extent, minimized.

In any event, there exists a need in the art for a washing machine incorporating a detergent collection arrangement which will substantially limit the amount of detergent reaching a drain of the machine during an initial fill operation such that sufficient amounts of detergent will be available for an improved wash cycle, instead of being wasted in the drainage zone. There particularly exists a need in the art for a detergent collection arrangement in a washing machine which does not employ a recirculation system.

SUMMARY OF THE INVENTION

The present invention is directed to providing a detergent collection tray in the sump area of an outer tub of a washing machine, particularly a horizontal axis washing machine. The sump area is exposed to a drain opening and the tray is mounted above the drain so as to cover the opening. More particularly, the tray extends above a bottom of the sump to allow the machine to drain. However, as liquid detergent enters a washing tub of the machine or a powdered detergent is washed into the outer tub, the detergent will flow into the tray so as to be prevented from flowing directly into the drainage zone. Therefore, the tray prevents the loss of detergent into the drainage zone by functioning to capture or collect the detergent for use during the washing operation. In accordance with the most preferred form of the invention, the tray is preferably sized to hold more than enough detergent needed for a full washing operation.

Although the invention may be used in various types of washing machines, it is particularly adapted for use in a washing machine which does not employ a recirculation system. In such machines, if detergent enters the drain, the detergent will become isolated from the laundry and is no longer available for washing of the clothes. In accordance with a preferred embodiment of the invention, ribs are provided on the tray to cause undissolved detergent to be retained in the tray. In addition, the outer tub is formed with structure which aids in mounting the detergent tray in the sump portion thereof. The invention also contemplates providing a spray or the like which functions to fill the drain to further prevent detergent from being lost.

Additional objects, features and advantages of the present invention will become more readily apparent from the following detailed description of a preferred embodiment when taken in conjunction with the drawing wherein like reference numerals referring to corresponding parts in the several views.

DETAILED DESCRIPTION OF THE PREFERRED EMBODIMENT

Figure 1:
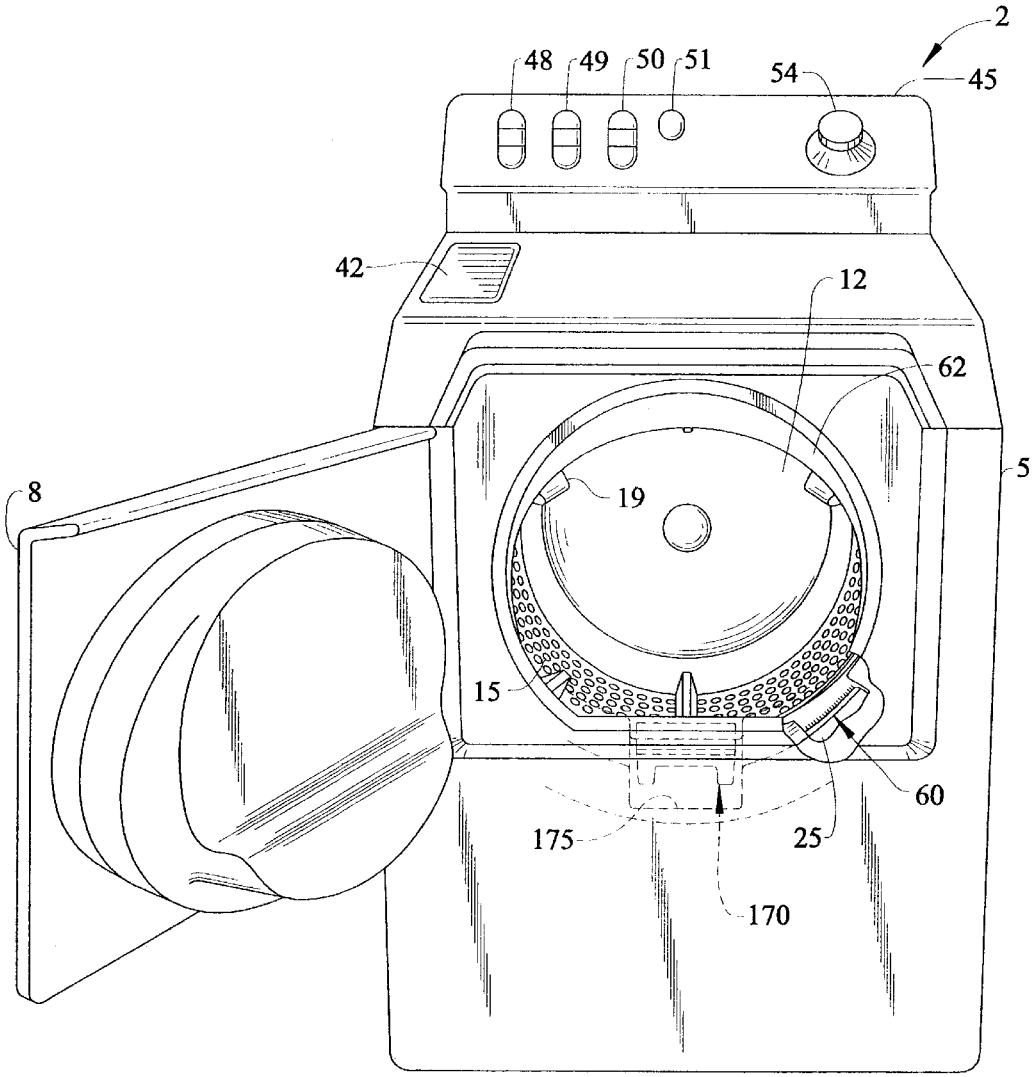
FIG. 1 is a perspective view of a horizontal axis washing machine incorporating the detergent tray arrangement of the invention.

With initial reference to FIG. 1, an automatic horizontal axis washing machine incorporating the control system of the present invention is generally indicated at 2. In a manner known in the art, washing machine 2 is adapted to be front loaded with articles of clothing to be laundered through a tumble-type washing operation. As shown, automatic washing machine 2 incorporates an outer cabinet shell 5 provided with a front door 8 adapted to extend across an access opening (not separately labeled). Front door 8 can be selectively pivoted to provide access to an inner tub or spinner 12 that constitutes a washing basket within which the articles of clothing are laundered.

Figure 3:
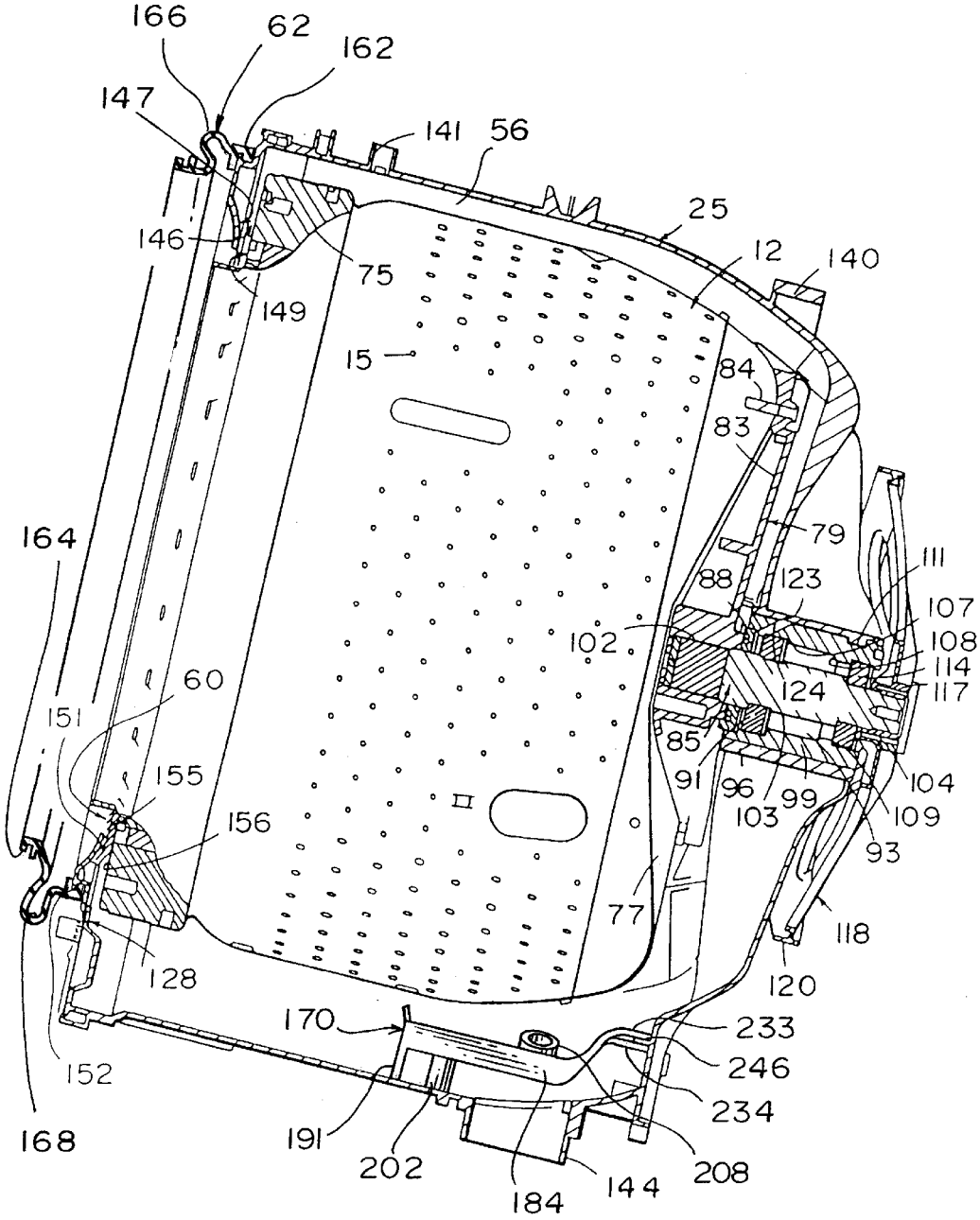
FIG. 3 is a cross-sectional view of the internal components of FIG. 2 in an assembled state.

As is known in the art, inner tub 12 is formed with a plurality of holes 15 and multiple, radially inwardly projecting fins or blades 19 are fixedly secured to inner tub 12. Inner tub 12 is mounted for rotation within an outer tub 25, which is supported through a suspension mechanism (not shown) within cabinet shell 5. Inner tub 12 is mounted within cabinet shell 5 for rotation about a generally horizontal axis. Actually, the rotational axis is angled slightly downwardly and rearwardly as generally represented in FIG. 3. Although not shown, a motor, preferably constituted by a variable speed, reversible electric motor, is mounted within cabinet shell 5 and adapted to drive inner tub 12. More specifically, inner tub 12 is rotated during both wash and rinse cycles such that articles of clothing placed therein actually tumble through either water, water/detergent or another washing medium supplied within inner tub 12. Given that inner tub 12 is provided with at least the plurality of holes 15, the water or water/detergent can flow between the inner and outer tubs 12 and 25. A pumping system (not shown) is provided to control the level of washing fluid within machine 2, with one pump particularly controlling the timed draining of the fluid from the outer tub 25.

Figure 2:
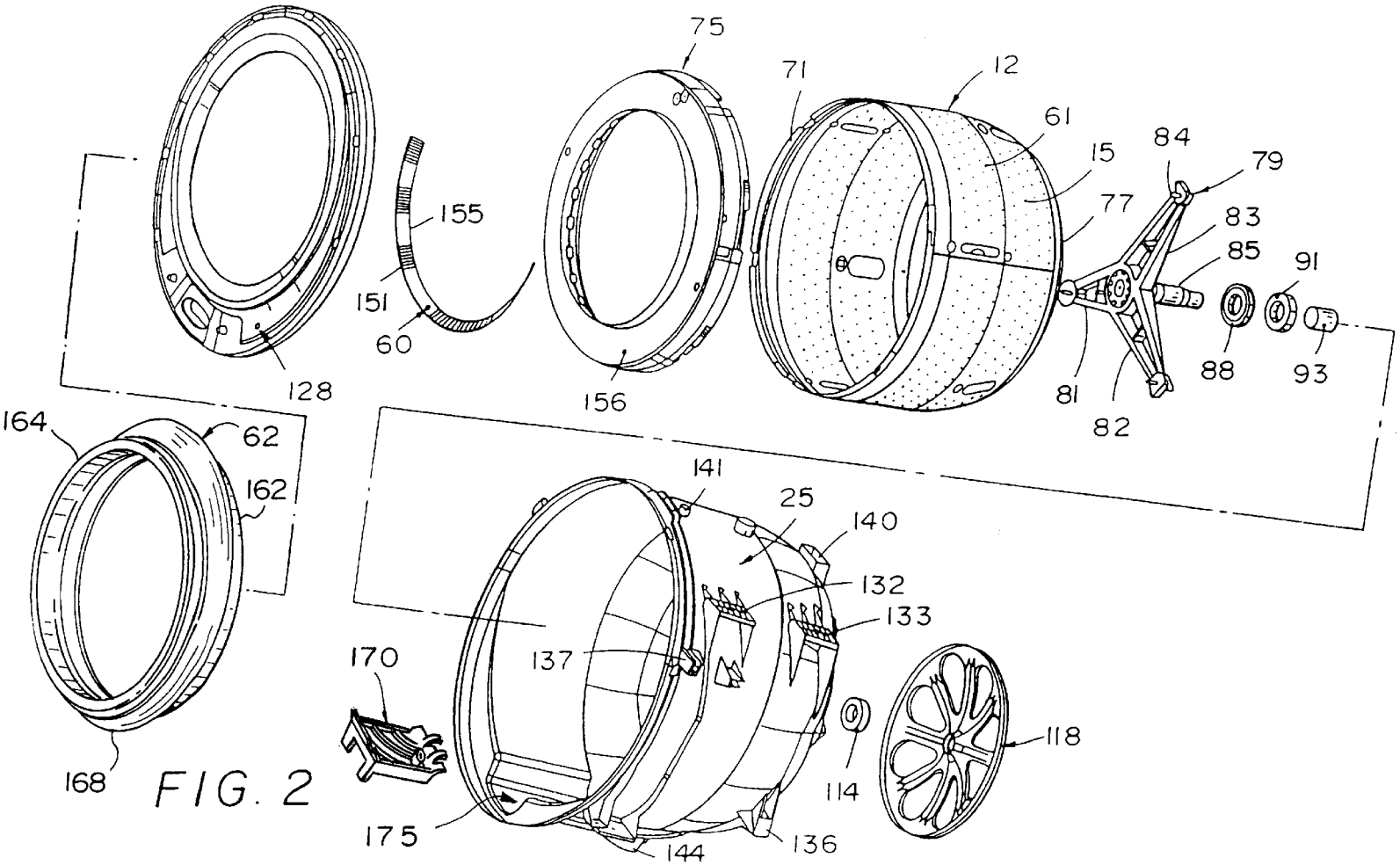
FIG. 2 is an exploded view of various internal components of the washing machine of FIG. 1.

Automatic washing machine 2 is also shown to include an upper cover 42 that provides access to an area for adding detergent, softeners and the like. In addition, an upper control panel 45, including various selector buttons 48–51 and a control knob 54, is provided for manually establishing a desired washing operation in a manner known in the art. In order to allow inner tub 12 to freely rotate within outer tub 25 during a given washing operation, inner tub 12 is spaced concentrically within outer tub 25 in the manner which will be detailed more fully below. This spacing establishes an annular gap (not labeled) between the inner and outer tubs 12 and 25. A flexible sealing device, generally indicated at 60 in FIGS. 1 and 3, functions to bridge this gap between inner and outer tubs 12 and 25 to prevent such objects from flowing into the outer tub 25. Further provided as part of washing machine 2 in a manner known in the art is a sealing boot 62 (see FIGS. 2 and 3) which extends generally between outer tub 25 and a frontal panel portion (not separately labeled) of cabinet shell 5. Reference now will be made to FIGS. 2 and 3 in describing the preferred mounting of inner tub 12 within outer tub 25 and the arrangement of both sealing device 60 and sealing boot 62.

Inner tub 12 has an annular side wall 61 and an open front rim 71 about which is secured a balance ring 75. In the preferred embodiment, balance ring 75 is injection molded from plastic, such as polypropylene, with the balance ring 75 being preferably mechanically attached to rim 71. Inner tub 12 also includes a rear wall 77 to which is fixedly secured a spinner support 79. More specifically, spinner support 79 includes a plurality of radially extending arms 81–83 which are fixedly secured to rear wall 77 by means of screws 84 or the like. Spinner support 79 has associated therewith a driveshaft 85. Placed upon driveshaft 85 is an annular lip seal 88. Next, a first bearing unit 91 is press-fit onto driveshaft 85. Thereafter a bearing spacer 93 is inserted upon driveshaft 85.

The mounting of inner tub 12 within outer tub 25 includes initially placing the assembly of inner tub 12, balance ring 75, spinner support 79, lip seal 88, first bearing unit 91 and bearing spacer 93 within outer tub 25 with driveshaft 85 projecting through a central sleeve 96 formed at the rear of outer tub 25. More specifically, a metal journal member 99 is arranged within central sleeve 96, with central sleeve 96 being preferably molded about journal member 99. Therefore, driveshaft 85 projects through journal member 99 and actually includes first, second and third diametric portions 102–104. In a similar manner, journal member 99 includes various diametric portions which define first, second and third shoulders 107–109. Journal member 99 also includes an outer recess 111 into which the plastic material used to form outer tub 25 flows to aid in integrally connecting journal member 99 with outer tub 25.

As best shown in FIG. 3, the positioning of driveshaft 85 in journal member 99 causes each of annular lip seal 88, first bearing 91 and bearing spacer 93 to be received within journal member 99. More specifically, annular lip seal 88 will be arranged between first diametric portion 102 of driveshaft 85 and journal member 99. First bearing unit 91 will be axially captured between the juncture of first and second diametric portions 102 and 103, as well as first shoulder 107. Bearing spacer 93 becomes axially positioned between first bearing unit 91 and second shoulder 108 of journal member 99. Thereafter, a second bearing unit 114 is placed about driveshaft 85 and inserted into journal member 99, preferably in a press-fit manner, with second bearing unit 114 being seated upon third shoulder 109. At this point, a hub 117 of a spinner pulley 118 is fixedly secured to a terminal end of driveshaft 85 and axially retains second bearing unit 114 in position. Spinner pulley 118 includes an outer peripheral surface 120 which is adapted to be connected to a belt driven in a controlled fashion by the reversible motor mentioned above in order to rotate inner tub 12 during operation of washing machine 2. In order to provide lubrication to lip seal 88, central sleeve 96 is formed with a bore 123 that is aligned with a passageway 124 formed in journal member 99.

Outer tub 25 has associated therewith a tub cover 128. More specifically, once inner tub 12 is properly mounted within outer tub 25, tub cover 128 is fixedly secured about the open frontal zone of outer tub 25. Although the materials for the components discussed above may vary without departing from the spirit of the invention, outer tub 25, balance ring 75 and tub cover 128 are preferably molded from plastic, while inner tub 12 is preferably formed of stainless steel. Again, these materials can vary without departing from the spirit of the invention. For example, inner tub 12 could also be molded of plastic.

Outer tub 25 is best shown in FIG. 2 to include a plurality of balance weight mounting gusset platforms 132 and 133, a rear mounting boss 136 and a front mounting support 137. It should be realized that commensurate structure is provided on an opposing side portion of outer tub 25. In any event, balance weight mounting platforms 132 and 133, mounting boss 136, mounting support 137 and further mounting boss 140 are utilized in mounting outer tub 25 within cabinet shell 5 in a suspended fashion. Again, the specific manner in which outer tub 25 is mounted within cabinet shell 5 is not considered part of the present invention, so it will not be described further herein. Outer tub 25 is also provided with a fluid inlet port 141 through which washing fluid, i.e., either water, water/detergent or the like, can be delivered into outer tub 25 and, subsequently, into inner tub 12 in the manner discussed above.

Furthermore, outer tub 25 is formed with a drain port 144 which is adapted to be connected to a pump for draining the washing fluid from with inner and outer tubs 12 and 25 during certain cycles of a washing operation.

As best illustrated in FIG. 3, inner tub 12 is entirely spaced from outer tub 25 for free rotation therein. This spaced relationship also exists at the front ends of inner and outer tubs 12 and 25 such that an annular gap 146 is defined between an open frontal zone 147 of outer tub 25 and an open frontal portion 149 associated with balance ring 75. It is through a lower section of gap 146 that washing fluid can also flow from within inner tub 12 to outer tub 25.

Flexible sealing device 60 is mounted so as to bridge gap 146 between inner and outer tubs 12 and 25 and, specifically, between balance ring 75 and tub cover 128. Gap 146 is required because of deflections between inner tub 12 and outer tub 25 during operation of washing machine 2. Sealing device 60 bridges gap 146 to prevent small items from passing through, but sealing device 60 is flexible so as to accommodate changes in the size of gap 146 resulting from deflections during operation. Sealing device 60 includes a first seal portion 151 that is fixed or otherwise secured to a rear or inner surface 152 of tub cover 128 and a second, flexible seal portion 155, such as brush bristles or a plastic film, which projects axially across gap 146 and is placed in close proximity and most preferably in sliding contact with a front or outer surface 156 of balance ring 75. As is also known in the art, sealing boot 62 includes an inner annular end 162 which is fixed to tub cover 128, an outer annular end 164 which is fixed to the front cabinet panel (not separately labeled) of cabinet shell 5 and a central, flexible portion 166. As perhaps best shown in FIG. 3, flexible portion 166 actually defines a lower trough 168.

During a normal washing operation, automatic washing machine 2 will proceed through a main wash cycle and a predetermined number of rinse cycles. In the main wash cycle, a preset amount of water is added to any detergent, or other washing solution supplied in the areas beneath cover 42, and inner tub or spinner 12 is driven to tumble articles of clothing through the resulting solution. In automatic washing machine 2, the tumbling period is determined within a CPU (not shown) which, in turn, signals wash and rinse cycle controls. Periodically, it is preferable to alter the rotational direction of inner tub 12 during this period to vary the tumbling pattern.

After the wash cycle tumbling time period has elapsed, a drain cycle is initiated with a continued tumbling action. In the preferred embodiment, this tumble drain period lasts approximately 90 seconds. Following the tumble drain, inner tub 12 is subjected to a spin mode wherein inner tub 12 spins at approximately 400 RPM for approximately two minutes. At this point, the water/detergent solution has been substantially removed from within inner tub 12, although the articles of clothing will certainly still possess a certain percentage of the solution. Next, the articles of clothing are subjected to the predetermined number of rinse cycles wherein inner tub 12 is filled to a predetermined level with water and placed in a rinse cycle tumble pattern. In the most preferred form, three rinse cycles are provided. In general, each of the rinse cycles sequentially incorporates a rinsing tumble mode, followed by a tumble drain, a pause drain and then a rinse cycle spin mode. Thereafter, a final draining occurs and inner tub 12 is allowed to coast to a stop position and the washing operation is completed. Further details of this overall operational sequence is described in commonly assigned U.S. Pat. No. 6,241,782 entitled Horizontal Axis Washing Machine Incorporating Flush Tumble Cycle issued Jun. 5, 2001, which is hereby incorporated by reference.

Figure 4:
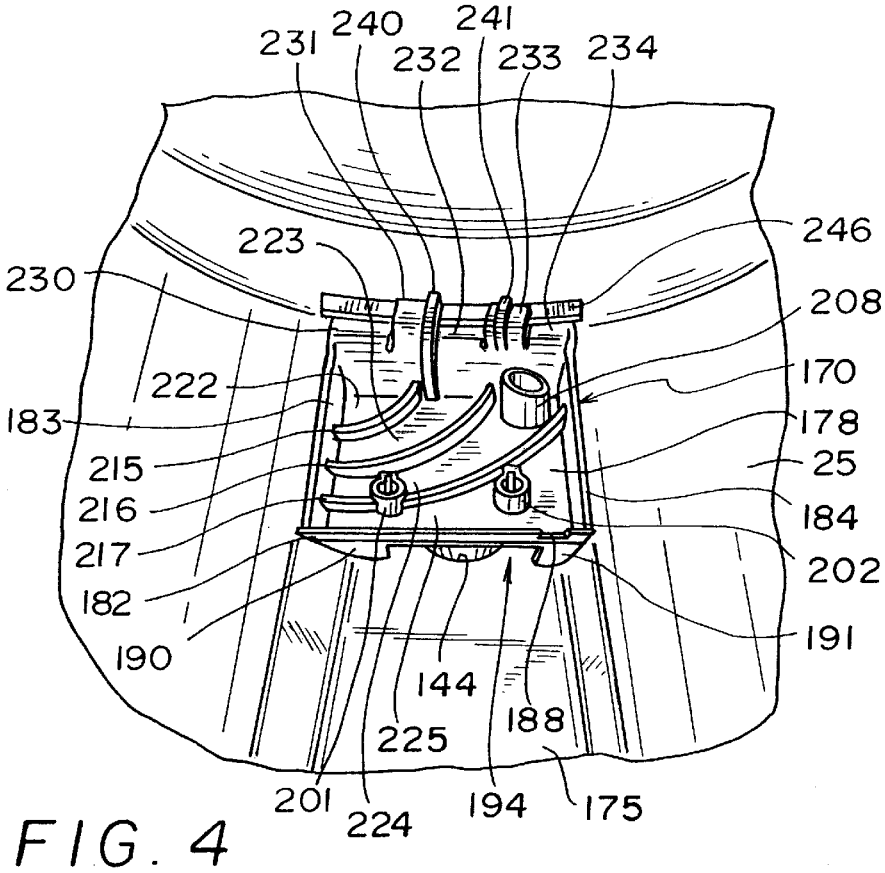
FIG. 4 is an enlarged view of a sump portion of the washing machine of FIG. 1 illustrating the mounting arrangement for the detergent tray.
Figure 5:
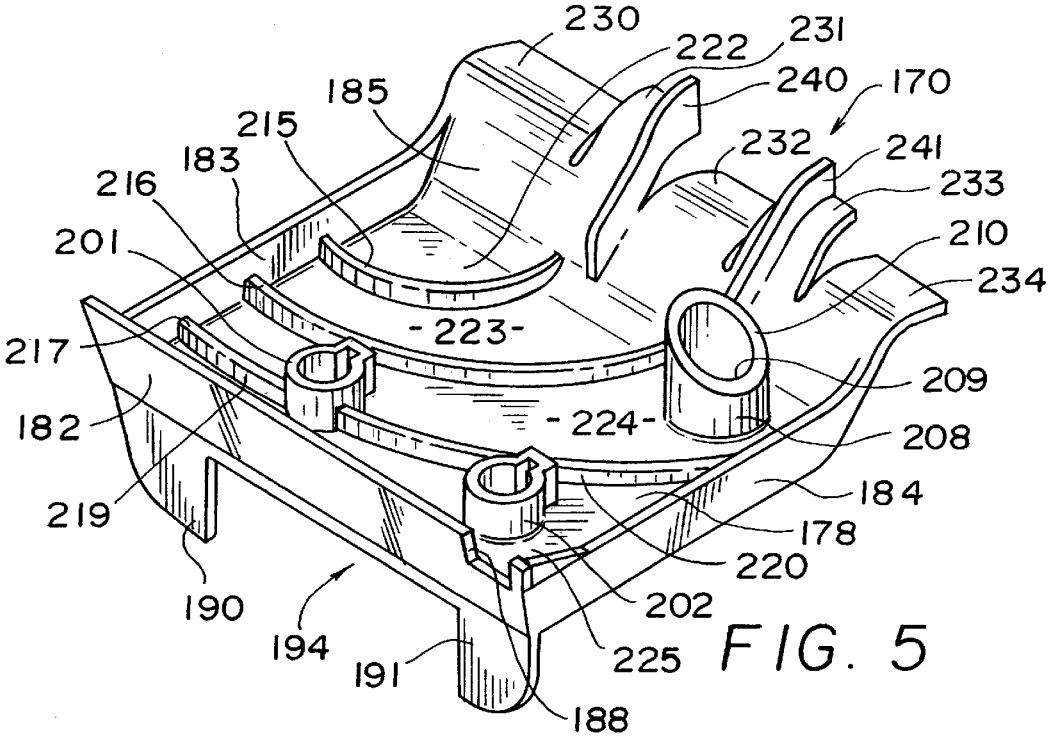
FIG. 5 is an upper right perspective view of detergent tray.

Until this point, the basic structure and operation of washing machine 2 is known in the art and has been described both for the sake of completeness and to establish the need and advantages of the system of the present invention. In accordance with the present invention, a detergent holder or tray 170 is provided in a sump portion 175 of outer tub 25 for use in collecting detergent, which would otherwise simply flow directly into drain port 144 during an initial fill operation, thereby enabling this detergent to provide an enhanced washing solution for the wash cycle. Prior to disclosing the overall operation of tray 170 in accordance with the present invention, the preferred construction and mounting thereof will now be described in detail with particular reference to FIGS. 3–5.

As shown, tray 170 includes a base 178 from which project upstanding front, side and rear walls 182–185. As shown, an optional notch 188 is formed in front wall 182 adjacent side wall 184. Extending downward below front wall 182 is a pair of support legs 190 and 191 which are spaced so as to define a frontal opening 194. In the most preferred form of the invention, the entire tray 170 is injection molded of plastic. Formed integral with base 178 is a pair of tubular bosses 201 and 202 which, as clearly shown in these Figures, extend both above and below base 178. Preferably, tubular bosses 201 and 202 extend downward from base 178 into abutting relationship with sump portion 175. As will be discussed further below, tubular bosses 201 and 202 are used in connection with both securing and supporting tray 170. Tray 170 is also formed with an upstanding member 208 that defines a port 209 extending through base 178. As shown, upstanding member 208 has a canted or sloped upper end 210. This particular shape is actually provided to aid in removing tray 170 from an injection mold. In addition, this arrangement provides a secondary water path during fill and drain operations. It is also contemplated that upstanding member 208 can be used to provide water circulation for an optional thermistor (not shown) in sump portion 175.

Also formed as part of base 178 are a plurality of upstanding ribs 215–217. As shown, rib 215 preferably extends in an arcuate fashion between side wall 183 and rear wall 185. In a similar fashion, rib 216 extends between side wall 183 and rear wall 185, while being spaced from rib 215. Finally, rib 217 extends in a generally arcuate fashion between side walls 183 and 184. As shown, rib 217 is actually in sections, with one section 219 extending between side wall 183 and tubular boss 201 and a second section 220 extending between tubular boss 201 and side wall 184. In any event, with this arrangement, ribs 215–217 define, in conjunction with walls 182–185, a plurality of collection zones 222–225.

Rear wall 185 of tray 170 is actually defined by a plurality of tab portions 230–234. As shown, tab portions 231 and 233 are preferably raised relative to tab portions 230, 232 and 234. Also provided is a pair of reinforcing ribs 240 and 241 for tab portions 231 and 233 respectively. As indicated above, tray 170 is adapted to be mounted within sump portion 175 of outer tub 25. In accordance with the preferred embodiment disclosed, tray 170 is preferably mounted directly over drain port 144. More specifically, as perhaps best shown in FIGS. 3 and 4, outer tub 25 is preferably provided with a forwardly projecting flange 246 that extends across the rear of sump portion 175. Flange 246 is adapted to extend across base 178 at rear wall 185, while being received between tab portions 230, 232, 234 and tab portions 231 and 233. That is, when tray 170 is positioned in sump portion 175 and then slid rearward into place, tab portions 230, 232 and 234 will be arranged below flange 246, while tab portions 231 and 233 will extend above flange 246. This configuration is clearly shown in FIG. 4. At the same time, support legs 190 and 191 rest upon outer tub 25 in sump portion 175. Also, tubular bosses 201 and 202 abut against outer tub 25. Although not shown, tubular bosses 201 and 202 preferably have internal, reduced diametric portions which enable mechanical fasteners, such as screws, to be placed therein and secured into outer tub 25 while the heads of the screws are retained within the tubular bosses 201 and 202. Therefore, in this fashion, tray 170 is positioned within a rear section of sump portion 175 while being supported at both the front and rear thereof, while also being fixedly secured to outer tub 25. In the most preferred form of the invention as clearly shown in FIG. 4, at least side walls 183 and 184 are preferably angled so as to conform to the shape of sump portion 175.

Since a prior operation of washing machine 2 would terminate in a final drain cycle, the drain system of washing machine 2 is essentially empty. Therefore, upon initiating a new cycle, the introduced washing medium or solution which, for purposes of this discussion, will be constituted by a combination of water and detergent, will actually flow through inner tub 12 and toward drain port 144. Of course, a percentage of the washing medium will be retained by the articles of clothing placed in inner tub 12 for laundering. For instance, the first 10–15 seconds of the fill portion of the wash cycle will essentially function to fill the drain system, including drain port 144. Due to the arrangement of the various components of washing machine 2, the initial fill fluid mainly comes down outer tub 25 at a rear portion thereof. Due to the position of tray 170, this initial filling medium must flow onto tray 170 before reaching drain port 144.

As indicated above, tray 170 is preferably sized to hold enough detergent for a full load. In any event, the initial surge of detergent will actually settle within zones 222–225 of tray 170, while mainly the water will flow over wall 182 toward sump portion 175. Notch 188 may optionally be provided to further control the level of liquid in tray 170. Furthermore, port 209 in upstanding member 208 acts as an overflow hole as well. In any event, tray 170 will function to collect the detergent and the drain system will be, effectively, filled with water. Since essentially the full amount of supplied detergent is available for the wash cycle, a more efficient and effective washing operation can be performed. That is, during the actual wash cycle, the washing solution is caused to flow through tray 170, particularly given the position of tray 170 in sump portion 175. Therefore, all of the detergent collected in tray 170 will essentially be carried out of tray 170 during the wash cycle. That is, the tumbling of inner tub 12 during the washing operation essentially agitates the detergent out of tray 170. Of course, the wash cycle is followed by the rinse cycles which further removes any residual detergent from tray 170 and the articles of clothing. The spin cycle portions of the overall washing operation particularly function to shake out any fluid in tray 170. It is also contemplated in accordance with the present invention to direct a spray of water into tray 170 before the rinse cycles to flush detergent and/or clothing dye therefrom.

Based on the above, it should be apparent that the inclusion of tray 170 can actually reduce the amount of detergent that needs to be supplied for a given washing operation since the supplied detergent is not wasted. In addition, since the detergent is not used to fill the drain system, a separate pump is not needed to recirculate the fluid medium in the drain. Obviously, reducing the number of required pumps represents a significant cost reduction, as well as an energy savings.

Although described with reference to a preferred embodiment of the invention, it should be readily understood that various changes and/or modifications can be made to the invention without departing from the spirit thereof. For instance, as a potential modification, a thermistor (not shown) could be mounted in upstanding member 208 for sensing the temperature of the washing solution, particularly if washing machine 2 is to incorporate a heater. In addition, although tray 170 is disclosed as being separately attached to outer tub 25, outer tub 25 could be integrally formed with such a tray arrangement. Of course, other attaching arrangements, such as a snap-fit connection, could also be employed. Certainly, the particular construction of tray 170, although considered advantageous, could be readily modified, particularly depending on the overall construction of outer tub 25 and the arrangement of the overall washing machine components. Furthermore, although described with reference to a horizontal axis-type washing machine 2, the detergent tray arrangement of the present invention could also be utilized in connection with a vertical axis-type washing machine having a corresponding sump portion. In any even t, the invention is only intended to be limited by the scope of the following claims.

We claim:

1. A clothes washing machine comprising:

a cabinet shell including a door;

an outer tub mounted within the cabinet shell;

a drain port leading from the outer tub;

an inner tub mounted for rotary movement within the outer tub, said inner tub being adapted to receive a washing medium, including a combination of water and detergent, and articles of clothing to be laundered in the washing medium; and a tray positioned above the drain port in the outer tub, said tray being adapted to collect at least a portion of the detergent during an initial fill operation of the clothes washing machine in order to prevent the detergent from flowing directly into the drain port.

2. The clothes washing machine according to claim 1, wherein the outer tub is formed with a sump portion, with said drain port opening into the sump portion, said tray being positioned in the sump portion.

3. The clothes washing machine according to claim 2, wherein the tray is positioned directly above the drain port.

4. The clothes washing machine according to claim 3, wherein the tray is mechanically connected to the outer tub.

5. The clothes washing machine according to claim 4, wherein the tray includes a plurality of tubular bosses through which mechanical fasteners are adapted to extend in order to secure the tray to the outer tub.

6. The clothes washing machine according to claim 1, wherein the tray includes a base and a plurality of upstanding side walls projected from the base.

7. The clothes washing machine according to claim 6, wherein the tray further includes a plurality of ribs extending up from the base.

8. The clothes washing machine according to claim 7, wherein the plurality of ribs are spaced along the base and extend between respective ones of the plurality of upstanding side walls so as to define various collection zones upon the base.

9. The clothes washing machine according to claim 6, wherein the tray further includes at least one support leg extending from the base and engaging the outer tub.

10. The clothes washing machine according to claim 9, wherein the plurality of upstanding side walls includes a rear wall, said rear wall being connected to the outer tub.

11. The clothes washing machine according to claim 10, wherein the rear wall is formed with a plurality of tab portions and said outer tub is formed with a projecting flange which is received between the tab portions in order to connect the rear wall to the outer tub.

12. The clothes washing machine according to claim 1, wherein the tray includes an overflow port extending through the base.

13. The clothes washing machine according to claim 1, wherein the clothes washing machine constitutes a non-recirculating type washing machine.

14. The clothes washing machine according to claim 13, wherein the clothes washing machine constitutes a horizontal axis washing machine adapted to subject the articles of clothing to a tumble-type washing operation.

15. A clothes washing machine comprising:

a cabinet shell including a door;

an outer tub mounted within the cabinet shell;

a drain port leading from the outer tub;

an inner tub mounted for rotary movement within the outer tub, said inner tub being adapted to receive a washing medium, including a combination of water and detergent, and articles of clothing to be laundered in the washing medium; and means, provided in a lower portion of the outer tub, for collecting at least a portion of the detergent during initiation of a wash cycle, wherein the collecting means includes a base and a plurality of upstanding side walls projected from the base.

16. The clothes washing machine according to claim 15, wherein the outer tub is formed with a sump portion, with said drain port opening into the sump portion, said collecting means being positioned in the sump portion, directly over the drain port.

17. The clothes washing machine according to claim 16, wherein the collecting means constitutes a tray.

18. The clothes washing machine according to claim 17, wherein the tray includes a plurality of tubular bosses through which mechanical fasteners are adapted to extend in order to secure the tray to the outer tub.

19. The clothes washing machine according to claim 15, wherein the collecting means further includes a plurality of ribs extending up from the base.

20. The clothes washing machine according to claim 19, wherein the plurality of ribs are spaced along the base and extend between respective ones of the plurality of upstanding side walls so as to define various collection zones upon the base.

21. The clothes washing machine according to claim 15, wherein the collecting means further includes at least one support leg extending from the base and engaging the outer tub.

22. The clothes washing machine according to claim 21, wherein the plurality of upstanding side walls includes a rear wall, said rear wall being connected to the outer tub.

23. The clothes washing machine according to claim 22, wherein the rear wall is formed with a plurality of tab portions and said outer tub is formed with a projecting flange which is received between the tab portions in order to connect the rear wall to the outer tub.

24. The clothes washing machine according to claim 15, wherein the collecting means includes an overflow port extending through the base.

25. The clothes washing machine according to claim 15, wherein the clothes washing machine constitutes a non-recirculating type washing machine.

26. The clothes washing machine according to claim 25, further including means for subjecting the articles of clothing to a tumble-type washing operation in the clothes washing machine by rotating the inner tub about a substantially horizontal axis.

27. A method of performing a washing operation on articles of clothing within a washing machine including an inner tub and an outer tub comprising:

initiating a fill operation by introducing both water and a detergent into the washing machine;

directing at least a portion of the water and detergent toward a drain port of the washing machine;

causing the portion of the water and detergent to flow into a tray prior to reaching the drain port;

collecting in the tray at least a substantial portion of the detergent from the portion of the water and detergent, while permitting the water to flow from the tray and to the drain port; and directing detergent collected in the tray into the inner tub during a wash cycle of the washing operation.

28. The method according to claim 27, further comprising:

collecting the detergent in one of a plurality of collection zones defined by spaced ribs projecting from a base of the tray.

29. The method according to claim 27, further comprising:

draining overflow from the base through a port extending through a base of the tray.

30. The method according to claim 27, further comprising:

causing substantially all of the detergent to be removed from the tray prior to terminating the wash cycle of the washing operation.

31. The method according to claim 27, further comprising:

subjecting the articles of clothing to a tumble-type washing operation in the clothes washing machine by rotating the inner tub about a substantially horizontal axis.

* * * * *